United States Patent [19]

Tsuji

[11] Patent Number: 4,982,817

[45] Date of Patent: Jan. 8, 1991

[54] GROUP SUPERVISION APPARATUS FOR ELEVATOR SYSTEM

[75] Inventor: Shintaro Tsuji, Inazawa, Japan

[73] Assignee: Mitsubishi Denki Kabushiki Kaisha, Japan

[21] Appl. No.: 422,684

[22] Filed: Oct. 17, 1989

[30] Foreign Application Priority Data

Oct. 19, 1988 [JP] Japan ..... 63-263086

[51] Int. Cl.[5] ..... B66B 1/18

[52] U.S. Cl. ..... 187/127

[58] Field of Search ..... 187/101, 124, 125, 127

[56] References Cited

U.S. PATENT DOCUMENTS

| | | | |
|---|---|---|---|
| 4,669,579 | 6/1987 | Ookubo | 187/124 |
| 4,685,536 | 8/1987 | Ichioka | 187/101 |
| 4,719,996 | 1/1988 | Tsuji | 187/127 |
| 4,802,557 | 2/1989 | Umeda et al. | 187/127 |
| 4,838,384 | 6/1989 | Thangavelu | 187/127 X |

FOREIGN PATENT DOCUMENTS

| | | |
|---|---|---|
| 55-32625 | 8/1980 | Japan . |
| 62-56076 | 11/1987 | Japan . |

*Primary Examiner*—A. D. Pellinen
*Assistant Examiner*—W. E. Duncanson, Jr.
*Attorney, Agent, or Firm*—Leydig, Voit & Mayer

[57] ABSTRACT

A group supervision apparatus for an elevator system having hall call registration devices for registering each hall when a hall button is depressed, assignment apparatus for selecting a cage to-serve from among a plurality of cages and assigning the selected cage to the hall call, cage control apparatus for performing operation controls such as determining travelling directions of the cages, starting and stopping the cages, and opening and closing doors of the cages, and for causing the cages to respond to cage calls and the hall calls allotted to the assigned cages, and standby devices for causing, when the cages have responded to all the calls, the cages to stand by at floors where they have responded, or to run to predetermined floors and stand by; the apparatus being so constructed that cage positions and cage directions of the respective cages to arise after the cage calls and the allotted hall calls have been successively responded to since the present point of time, during a predetermined time, are predictively calculated by cage position prediction devices, that temporal intervals or spatial intervals of the respective cages to arise after the lapse of the predetermined time are predictively calculated on the basis of the predicted cage positions and the predicted cage directions by cage interval prediction devices, and that at least one of the assignment apparatus, the cage control apparatus and the standby devices is operated using the predicted cage intervals.

6 Claims, 10 Drawing Sheets

GROUP SUPERVISION APPARATUS FOR ELEVATOR SYSTEM

BACKGROUND OF THE INVENTION

This invention relates to a group supervision apparatus for an elevator system wherein a service cage is selected from among a plurality of cages and is assigned to a hall call, and wherein a cage is caused to respond to a call or to stand by.

In a case where a plurality of cages are juxtaposed, a group supervision operation is usually performed. One type of group supervision operation is an assignment system. This system is such that, as soon as a hall call is registered, assignment estimation values are calculated for the respective cages, the cage of the best estimation value is selected and assigned as a cage to-serve, and only the assigned cage is caused to respond to the hall call, thereby to enhance service efficiency and to shorten hall wait time. In the group-supervisory elevator system based on such an assignment system, arrival pre-announcement lamps for the individual cages and individual directions are commonly installed at the hall of each floor, whereby the pre-announcement display of the assigned cage is presented to a user waiting at the hall. Therefore, the waiting user can wait for the cage in front of the pre-announcement display without anxiety.

The assignment estimation values in the system for assigning the cage to the hall calls as stated above are calculated on the basis that, assuming present circumstances to proceed as they are, which of the cages should optimally be assigned the hall call. More specifically, on the basis of cage positions and cage directions at present and hall calls and cage calls presently registered, there are obtained predictive values of the periods of time required for each cage to successively respond to the calls and arrive at the halls of the corresponding floors (hereinbelow, termed "arrival expectation times") and the periods of time having lapsed since the registrations of the hall calls (hereinbelow, termed "continuation times"). Further, the arrival expectation times and the corresponding continuation times are added to calculate the prediction wait times of all the hall calls presently registered. Besides, the summation of the prediction wait times or the summation of the squared values of the prediction wait times is set as the assignment estimation value, and the first-mentioned hall call is allotted to the cage whose assignment estimation value becomes the minimum. With such a prior-art system, in the case of allotting the hall call, whether or not the alloted cage is the optimal is determined according to the present circumstances. For this reason, there has occurred the drawback that a hall call registered anew after the allotment results in a long wait.

Examples of the occurrence of the drawback will be explained with reference to FIGS. 12–15. In FIG. 12, letters A and B designate Cage No. 1 and Cage No. 2, respectively, both of which are standing by under closed door states. It is assumed that, in such circumstances, down calls 7*d* and 6*d* are respectively registered in the 7th floor and 6th floor successively as illustrated in FIG. 13. According to the assignment estimation values of the prior-art assignment system, the down call 7*d* of the 7th floor is allotted to the cage A and the down call 6*d* of the 6th floor to the cage B so as to minimize the wait times as a whole. Thus, both the cages travel upwards, and then reverse their travelling directions in the 7th and 6th floors substantially at the same time.

Assuming that a down call is registered in any floor above the 7th floor, for example, in the 8th floor after the reversals of the directions, it becomes a rear call for the travelling directions of the cages A and B. Whichever cage may be assigned, the down call 8*d* of the 8th floor requires a long wait-time till a response thereto can be provided.

On the other hand, in a case where the down call 7*d* of the 7th floor is allotted to the cage A and where the down call 6*d* of the 6th floor is thereafter registered, this call is assumed to be also allotted to the cage A. Then, as illustrated in FIG. 14, even when the down call 8*d* of the 8th floor is simultaneously registered, the cage B standing by in the b 1l st floor does a direct travel service, and hence, the down call 8*d* does not become the long wait. In this manner, in order to prevent long waits, the hall calls need to be allotted so as to prevent the cages from gathering together in one place, considering how the cages will be arranged in the near future and even by temporarily performing an allotment which prolongs wait times.

With a so-called zone assignment system, in which a building is divided into a plurality of floor zones and in which cages are assigned to the respective zones so as to serve hall calls the hall calls are responded to as illustrated in FIG. 15, and the long wait of the down call 8*d* of the 8th floor is avoided. Since, however, the floors included in the respective zones are fixed, the down-call 8*d* of the 8th floor results in a long wait as will be explained herebelow: By way of example, in a case where a down call from the 5th floor is registered, unlike the down call 6*d* from the 6th floor, the down calls of the 7th floor and 5th floor are separately allotted to the respective cages A and B without a response to the down call 8*d* of the 8th floor as in the case of FIG. 14. In this manner, the zone assignment system cannot flexibly cope with the registered situation of the hall calls, and it also has the problem that a long wait call arises.

In addition, the official gazette of Japanese Patent Application Publication No. 32625/1980 discloses an assignment system wherein, in order to prevent cages from gathering together in one place and to attain an enhanced service efficiency likewise to the zone assignment system, when a hall call is registered, the cage scheduled to stop in a floor near that of the call is assigned to the call. Even in this assignment system, merely note is taken of the presence of the cage which is scheduled to stop in the near floor, and a judgement is not made by accurately grasping the changes of cage arrangements with the lapse of time, such as how long the cage scheduled to stop takes to arrive at the floor, how other hall calls are distributed and registered and when they will possibly be responded to, and what floors the other cages lie in and which directions they will travel in. Accordingly, there is left the problem that long wait calls similarly arise.

Further, the official gazette of Japanese Patent Application No. 56076/1987 discloses, in an elevator system wherein cages are caused to stand by at positions where passengers have alighted from the cages, an assignment system in which when a hall call occurs anew, it is tentatively allotted to the respective cages in succession so as to expect the alighting positions of the tentative assignment cages, the degrees of dispersion of the cages are calculated from the expected alighting positions of the tentative assignment cages and the positions of the other cages, at least the degrees of dispersion are used as the estimation values of the respective cages, and an assignment cage is determined from the estimation values of the respective cages so that the cage exhibiting a higher degree of dispersion may be assigned more easily. Thus, the cages are dispersively arranged even after the end of the service to the hall call, and the wastefull operations of unoccupied cages ascribable to the dispersive standby are prevented, so that a great effect is demonstrated for saving energy. Another effect is that the disrust of the inhabitants of a building equipped with the elevator system can be eliminated. As apparent from its object, however, this assignment system is directed toward a time zone of light traffic such as the nighttime, and it is premised on a case where one hall call is registered in the state in which all the cages are standing by as the unoccupied cages. Therefore, this assignment system cannot be applied to the allotment of hall calls in such a traffic situation that the hall calls are successively registered and that the cages are respectively travelling while responding to the calls, and it has the problem that long waits arise. Such a problem is caused by the fact that, since the assignment system is intended to balance the arrangement of the unoccupied cages, it does not consider the changes of cage positions with the lapse of time for the cages other than each tentative assignment cage (in view of the premise, the assignment system need not consider the changes of the cage positions of the other cages), and the fact that the hall call allotment is judged by taking note only of the cage arrangement at the point of time at which the tentative assignment cage will be alighted from (at that point of time, all the cages will become unoccupied and fall into standby states).

SUMMARY OF THE INVENTION

This invention has been made in order to solve the problems stated above, and has for its object to provide a group supervision apparatus for an elevator system which is permitted to accurately grasp the changes of cage arrangements with the lapse of time and which can shorten the wait times of future hall calls with respect to the present time.

A group supervision apparatus for an elevator system in this invention consists, in a group-supervisory elevator system having hall call registration means for registering hall calls when respective hall buttons are depressed, assignment means for selecting a cage to-serve from among a plurality of cages and assigning the selected cage to each hall call, cage control means for performing operation controls such as determining travelling directions of the cages, starting and stopping the cages, and opening and closing doors of the cages, and for causing the cages to respond to cage calls and the hall calls allotted to the assigned cages, and standby means for causing, when the cages have responded to all the calls, the cages to stand by at floors where they have responded, or to run to predetermined floors and stand by. Cage positions and cage directions of the respective cages which arise after the cage calls and the allotted hall calls have been successively responded to since the present point of time, during a predetermined time, are predictively calculated by cage position prediction means, temperal intervals or spatial intervals of the respective cages which arise after the lapse of the predetermined time are predictively calculated on the basis of the predicted cage positions and the predicted cage directions by cage interval prediction means, and at least one of said assignment means, said cage control means and said standby means is operated using the predicted cage intervals.

With the group supervision apparatus for an elevator system in this invention, at least one of the assignment operation, the cage control operation and the standby operation as predetermined is carried out using the predictive values of the temporal intervals or spatial intervals of the respective cages as predicted to arise after the lapse of the predetermined time.

BRIEF DESCRIPTION OF THE DRAWINGS

Throughout the drawings, the same symbols indicate identical portions or equivalent portions.

DESCRIPTION OF THE PREFERRED EMBODIMENTS

FIG. 1–10 are diagrams showing one embodiment of this invention. In the embodiment, it is assumed that four cages are installed in a 12-storeyed building.

Figure 1:
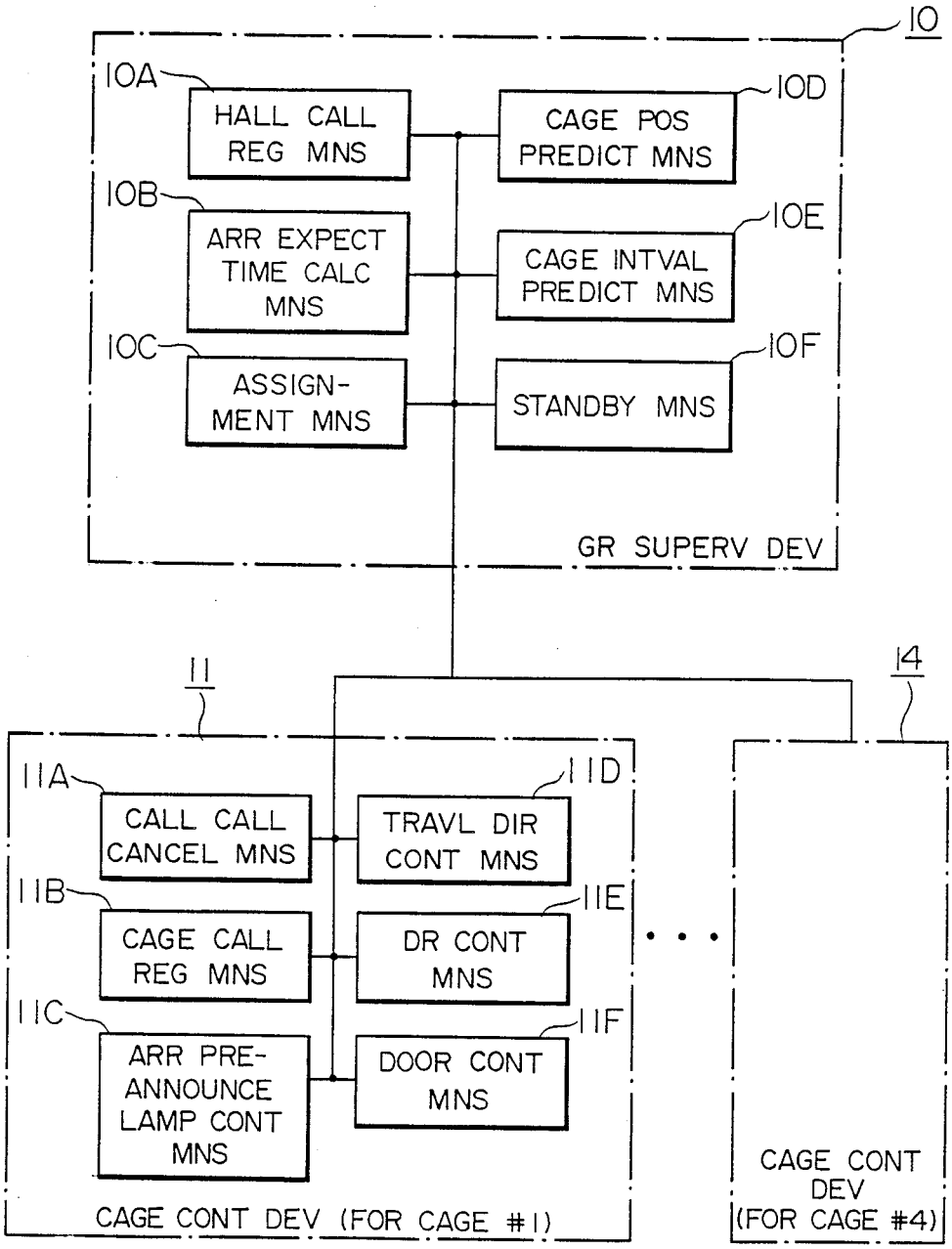
FIG. 1 is a general arrangement diagram of a group supervision apparatus for an elevator system according to this invention.

FIG. 1 is a diagram of the general arrangement of the embodiment, which is constructed of a group supervision device 10 and cage control devices 11–14 for the cages No. 1–No. 4 to be controlled by the former device 10. Symbol 10A denotes hall call registration means for registering and cancelling the hall calls (up calls and down calls) of the respective floors and for calculating periods of time elapsed since the registrations of the hall calls, namely, continuation times, symbol 10B denotes arrival expectation time calculation means for calculating the predictive values of periods of time required for the respective cages to arrive at the halls of the floors (in individual directions),namely, arrival expectation times, and symbol 10C denotes assignment means for selecting one cage best to serve the hall call and assigning the selected cage to this hall call, the assignment means executing an assignment calculation on the basis of the predictive wait times of the hall call and predictive number of cages to be described later. Cage position prediction means 10D predictively calculates the cage positions and cage directions of the cages to arise after a predetermined period of time T has lapsed since the present point of time, cage interval prediction means 10E predictively calculates the temporal intervals or spatial intervals of the respective cages to arise after the lapse of the predetermined time T, on the basis of the predicted cage positions and the predicted cage directions, and standby means 10F causes, when the cages have responded to all calls, the cages to stand by in the floor where they have responded or in the specified ones of the floors.

The cage control device 11 for Cage No. 1 is provided with well-known hall call cancellation means 11A for outputting hall call cancellation signals for the hall calls of the respective floors, well-known cage call registration means 11B for registering the cage calls of the respective floors, well-known arrival preannouncement lamp control means 11C for controlling the lighting of arrival preannouncement lamps (not shown) disposed in the respective floors, well-known travelling direction control means 11D for determining the travelling direction of the cage, well-known drive control means 11E for controlling the run and stop of the cage in order to reserve the cage and to respond to the hall call allotted to the cage, and well-known door control means 11F for controlling the opening and closure of the door of the cage. Incidentally, each of the cage control devices 12–14 for Cages Nos. 2–4 is constructed similarly to the cage control device 11 for Cage No. 1.

Figure 2:
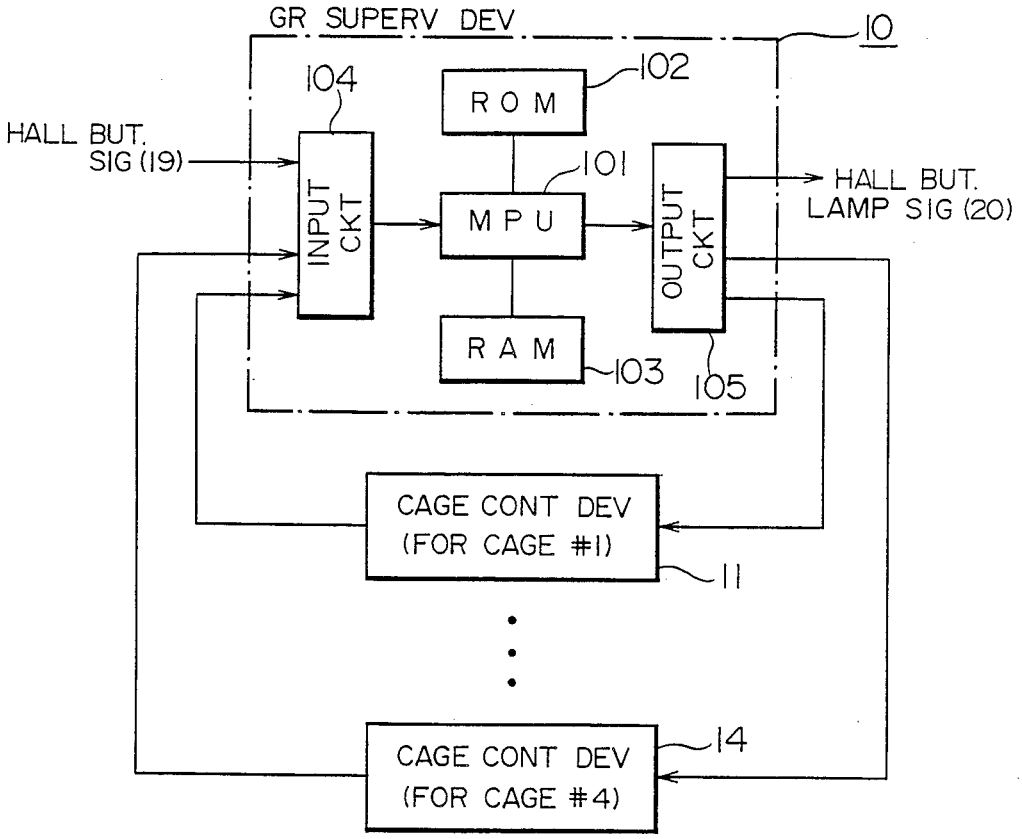
FIG. 2 is a block circuit diagram of a group supervision device (10)

FIG. 2 is a block circuit diagram of the group supervision device 10. The group supervision device 10 is constructed of a microcomputer, which includes an MPU (microprocessing unit) 101, a ROM 102, a RAM 103, an input circuit 104 and an output circuit 105. The input circuit 104 receives hall button signals 19 from hall buttons disposed in the respective floors and the state signals of Cages Nos. 1–4 from the respective cage control devices 11–14, while the output circuit 105 delivers signals 20 to hall button lamps built in the respective hall buttons and command signals to the cage control devices 11–14.

Figure 3:
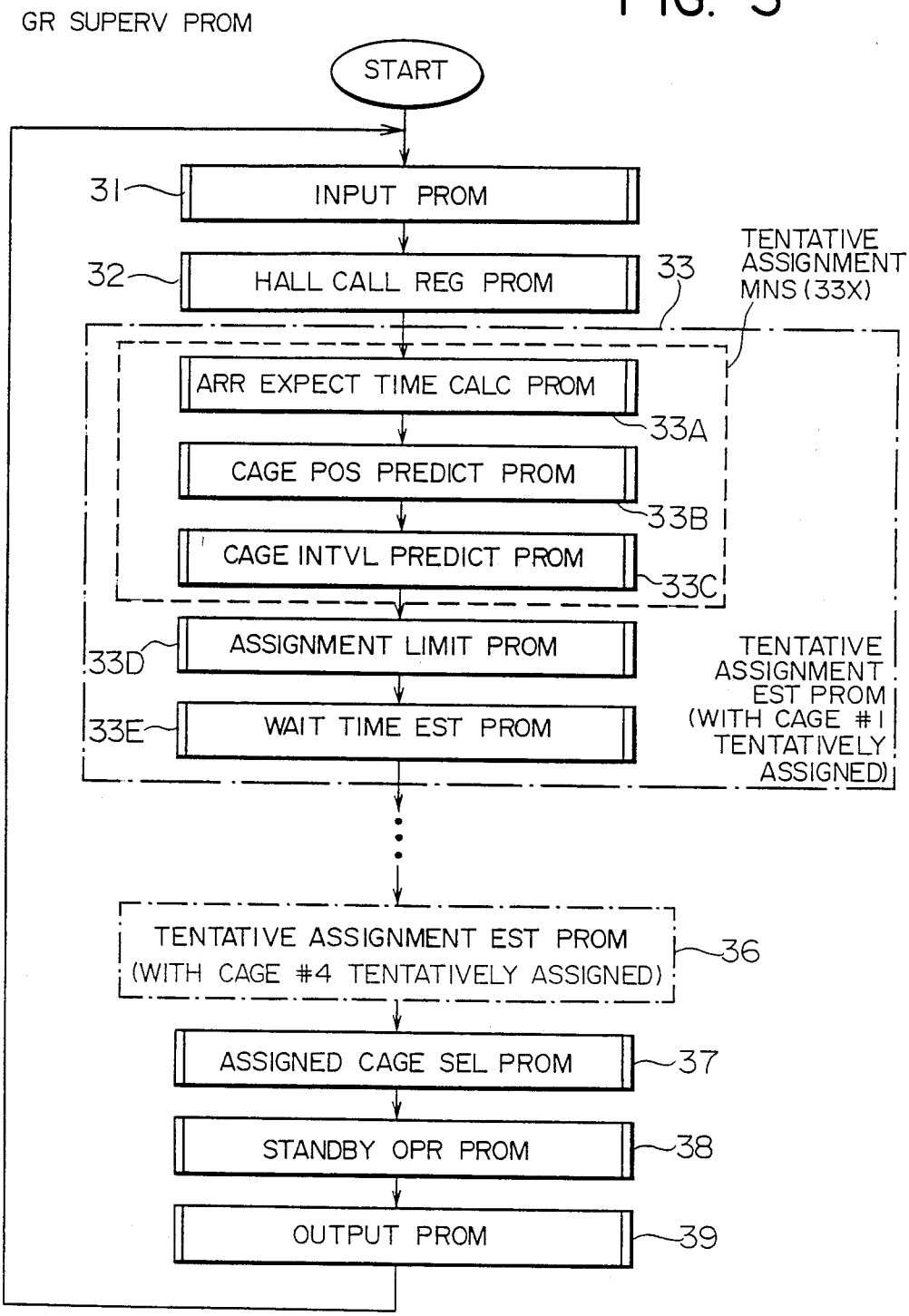
FIG. 3 is a flow chart of a group supervision program.
Figure 4:
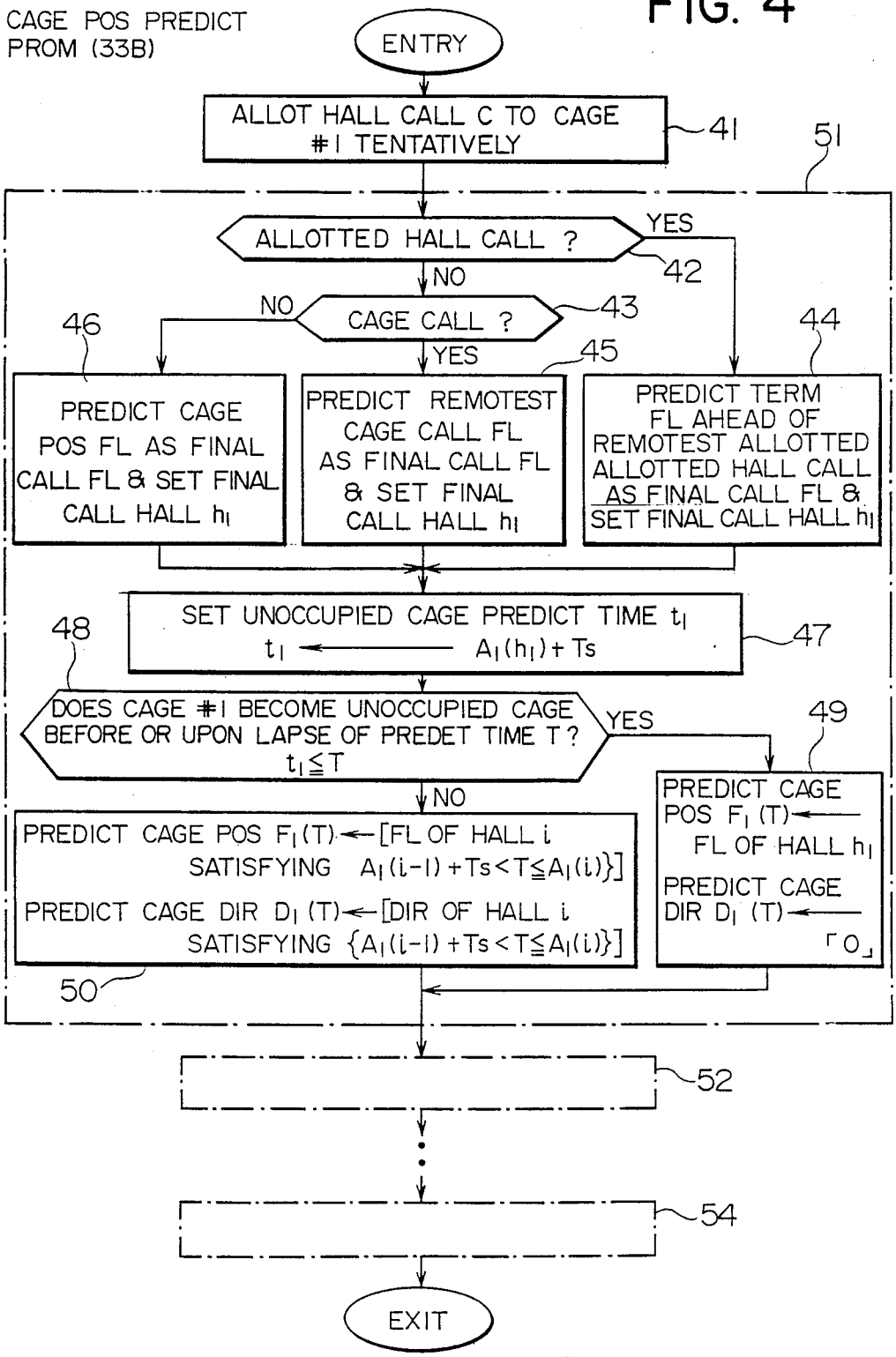
FIG. 4 is a flow chart of a cage position prediction program.
Figure 5:
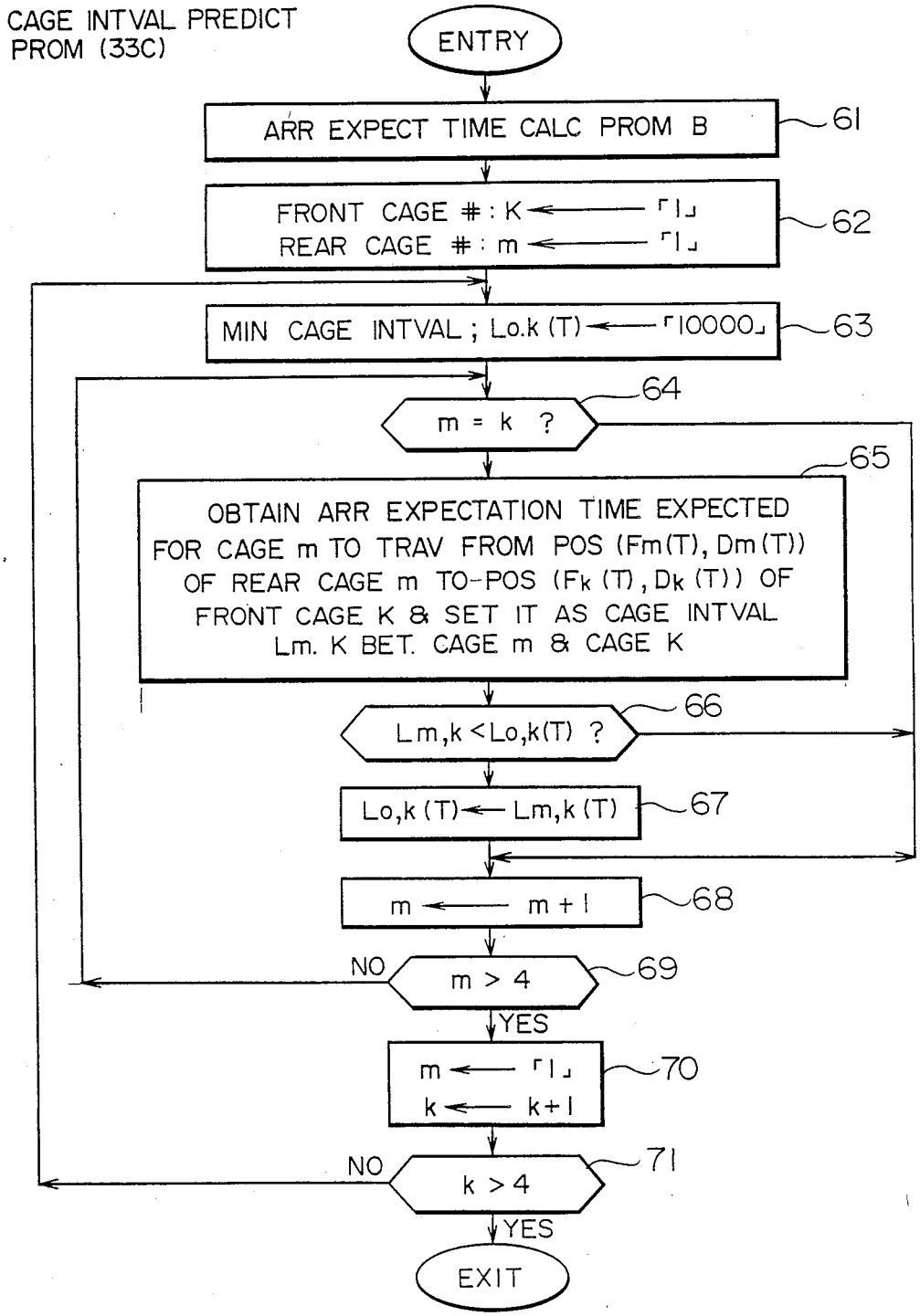
FIG. 5 is a flow chart of a cage interval prediction program.
Figure 6:
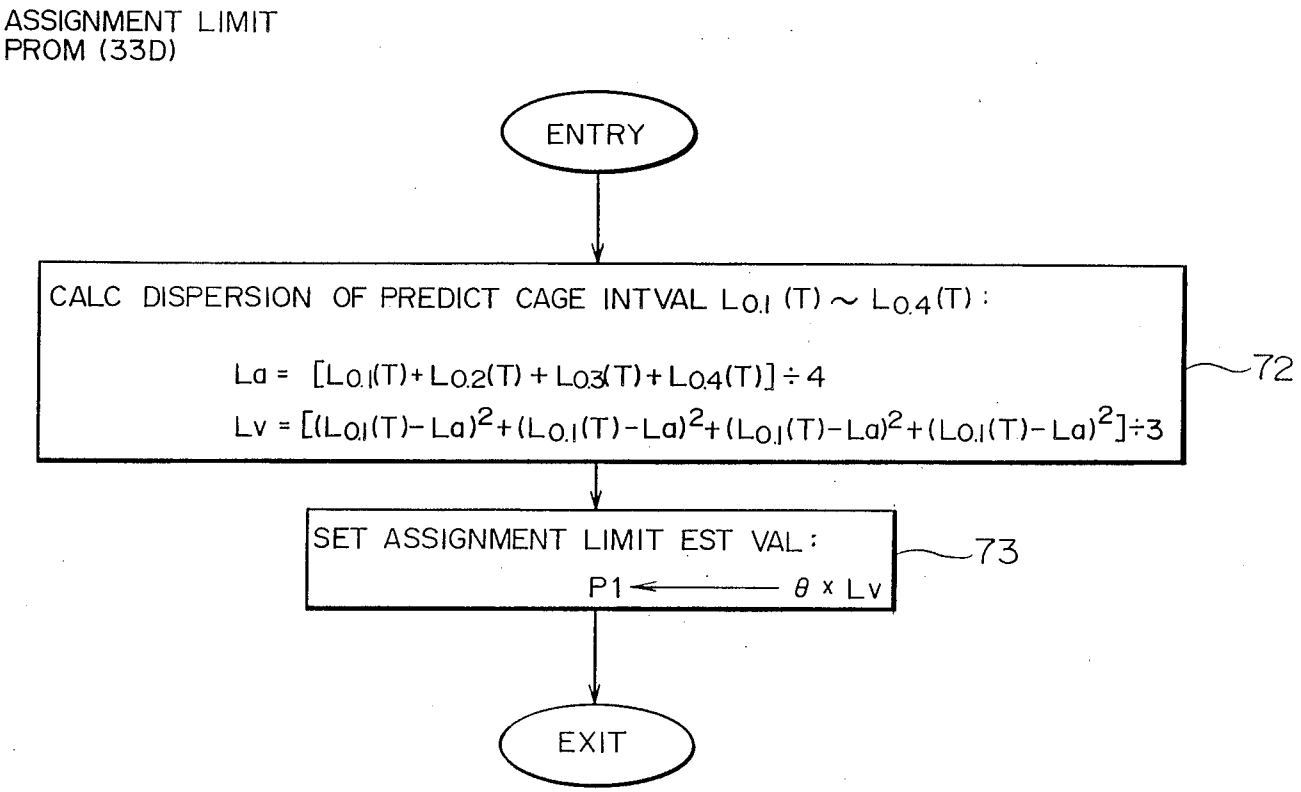
FIG. 6 is a flow chart of an assignment limitation program.
Figure 7:
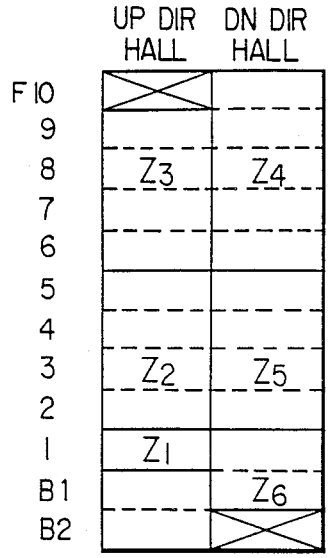
FIG. 7 is a diagram showing the division of a building into zones.

Now, the operation of this embodiment will be described with reference to FIGS. 3–7. FIG. 3 is a flow chart showing a group supervision program which is stored in the ROM 102 of the microcomputer constituting the group supervision device 10, FIG. 4 is a flow chart elucidating the cage position prediction program of the group supervision program, FIG. 5 is a flow chart elucidating the cage interval prediction program thereof, FIG. 6 is a flow chart elucidating the assignment limitation calculation program thereof, and FIG. 7 is diagram showing the state in which a building is divided into a plurality of floor zones.

First, a group supervision operation will be outlined in connection with FIG. 3.

An input program at a step 31 is a well-known one which functions to receive the hall button signals 19 and the state signals from the cage control devices 11–14 (such as signals on the positions and directions of the cages, the stop and run of the cages, the open and closed states of the doors, cage loads, cage calls, and hall call cancellations).

A hall call registration program at a step 32 is a well-known one which functions to decide the registration or cancellation of the hall call and the lighting or extinction of the hall button lamps and to calculate the continuation time of the hall call.

In tentative assignment estimation programs at steps 33–36, when a hall call C is registered anew, it is tentatively allotted to the respective cages Nos. 1–4, and assignment limitation estimation values P1–P4 as well as wait time estimation values W1–W4 on that occasion are respectively calculated.

In an arrival expectation time calculation program 33A contained in the tentative assignment estimation program 33 for Cage No. 1, arrival expectation times Aj(i) for arriving at halls i (where i=1, 2, 3, . . . and 11 denote the up direction halls of basement B2 and B1 and floors 1, . . . and 9, respectively, and i=12, 13, . . . 21 and 22 denote the down direction halls of the floors 10, 9, . . . and 1 and the basement B1, respectively) in the case of tentatively allotting the new registered hall call C to Cage No. 1 are calculated for each of the cages j (j=1, 2, 3 and 4). The arrival expectation times are calculated assuming by way of example that the cage expends 2 seconds in advancing a distance of one floor and 10 seconds on one stop, and that the cage is sequentially driven up and down throughout all the floors. Regarding the cage of no direction, the arrival expectation time is calculated assuming that the cage travels from the cage position floor thereof directly to each floor. Incidentally, the calculation of the arrival expectation time is well known.

In the cage position prediction program at a step 33B, the predictive cage positions F1(T)–F4(T) and predictive cage directions D1(T)–D4(T) of Cages Nos. 1–4 after the lapse of a predetermined time T in the case of tentatively allotting the new hall call C to Cage No. 1 are predictively calculated for the respective cages. This program 33B will be described in detail with reference to FIG. 4.

In the cage position prediction program 33B of FIG. 4, the new hall call C is tentatively allotted to Cage No. 1 at a step 41. A step 51, namely, steps 42–50 indicate(s) a procedure for calculating the predictive cage position F1(T) and predictive cage direction D1(T) of Cage No. 1 to arise after the predetermined time T. In the presence of any allotted hall call to which Cage No. 1 has been assigned, the calculative flow proceeds from the step 42 to the step 44. Here, the terminal floor lying ahead of the remotest allotted hall call is predicted as the final call floor of Cage No. 1 and is set as a final call prediction hall h1 by considering also the arrival direction of the cage in that floor (the down direction in the top floor, and the up direction at the lowermost end). In addition, when Cage No. 1 does not have any allotted hall call but has only cage call or calls, the calculative flow proceeds along the steps 42→43→45. Here at the step 45, the remotest cage call floor is predicted as the final call floor of Cage No. 1 and is set as a final call prediction hall h1 by considering also the arrival direction of the cage at that time. Further, when Cage No. 1 has neither an allotted hall call nor a cage call, calculative flow proceeds along the steps 42→43→46. Here at the step 46, the cage position floor of Cage No. 1 is predicted as the final call floor thereof and is set as a final call prediction hall h1 by considering also the cage direction at the time.

When the final call prediction hall h1 has been obtained in this way, the predictive value of a period of time required until Cage No. 1 becomes an unoccupied cage (hereinbelow, termed the "unoccupied cage prediction time") as indicated by t1 is subsequently obtained at the step 47. The unoccupied cage prediction time t1 is found in such a way that the predictive value Ts (=10 seconds) of the stop time at the final call prediction hall h1 is added to the arrival expectation time A1(h1) for arriving at the prediction hall h1. By the way, in the case where the cage position floor has been set as the final call prediction hall h1, the remaining time of the stop time is predicted depending upon the states of the cage (such as the states in which the cage is running or is being decelerated, and a door opening operation is proceeding, the door is open, or a door closing operation is proceeding) and it is set as the unoccupied cage prediction time t1.

Subsequently, the predictive cage position F1(T) and predictive cage direction D1(T) of Cage No. 1 after the predetermined time T are calculated at the steps 48–50. When the unoccupied cage prediction time t1 of Cage No. 1 is not greater than the predetermined time, it is meant that Cage No. 1 becomes the unoccupied cage before or upon the lapse of the predetermined time T. Therefore, the calculative flow proceeds from the step 48 to the step 49, at which on the basis of the final call prediction hall h1, the floor of this hall h1 is set as the predictive cage position h1(T) predicted to arise after the lapse of the predetermined time T. Besides, the predictive cage direction D1(T) is set at "0". Incidentally, regarding the predictive cage direction D1(T), "0" denotes no direction, "1" denotes the up direction, and "2" denotes the down direction.

On the other hand, when the unoccupied cage prediction time t1 of Cage No. 1 is greater than the predetermined time T, it inplies that Cage No. 1 does not becomes an unoccupied cage upon the lapse of the predetermined time T. Therefore, the calculative flow proceeds from the step 48 to the step 50, and here, the floor of the hall i as to which the arrival expectation time A1(i−1) of the hall (i−1) and the A1(i) of the hall i fall into a relationship $\{A1(i-1)+Ts \leqq T < A1(i)+Ts\}$ is set as respective cage position F1(T) predicted to arise after the lapse of the predetermined time T, and the same direction as that of this hall i is set as the predictive cage direction D1(T).

In this way, the predictive cage position F1(T) and predictive cage direction D1(T) for Cage No. 1 are calculated at the step 51. Also the predictive cage positions F2(T)–F4(T) and predictive cage directions D2(T)–D4(T) for Cages Nos. 2–4 are respectively calculated by steps 52–54 each of which is identical in procedure to the step 51.

Referring to FIG. 3 again, in the cage interval prediction program at a step 33C, the intervals of the respective cages after the lapse of the predetermined time T in the case of tentatively allotting the new hall call C to cage No. 1 are predictively calculated. This program 33C will be described in detail with reference to FIG. 5.

In the cage interval prediction program 33C of FIG. 5, on the basis of the predictive cage positions F1(T)–F4(T) and predictive cage directions D1(T)–D4(T) after the lapse of the predetermined time T as calculated by the cage position prediction program 33B, a step 61 further calculates the arrival expectation times B1(i)–B4(i) of the respective cages since the corresponding point of time for arriving at the respective floors i (i=1, 2, . . . and 22). The method of the calculation is similar to the calculating method of the arrival expectation time calculation program 33A.

A step 62 initializes No. k of a front cage to "1" and No. m of a rear cage to "1". Further, at a step 63, the minimum cage interval L0,k(T) is initialized to a value as large as "10000". When a step 64 decides that the rear cage m and the front cage k are not identical, it is followed by a step 65.

At the step 65, an arrival expectation time expected for the rear cage m to reach the hall at which the front cage k lies (the hall which corresponds to the predictive cage position Fk(T) and the predictive cage direction Dk(T)) is obtained on the basis of the arrival expectation times Bm(1)–Bm(22), and it is set as a predictive cage interval Lm,k(T). By the way, when the front cage k is expected to become an unoccupied cage, this embodiment shall obtain the predictive cage interval Lm,k(T) under the condition that the hall at which the front cage k lies is regarded as a hall in the up direction, for the sake of simplicity. (Needless to say, it is more effective that the hall at which the cage of no direction lies is changed into a hall in the up direction or a hall in the down direction, depending upon the situations of the other cages.)

A step 66 compares the minimum cage interval L0,k(T) and the predictive cage interval Lm,k(T). If Lm,k(T)<L0,k(T) holds, the calculative flow proceeds to a step 67, at which Lm,k(T) is set as minimum cage interval L0,k(T) again to renew the minimum cage interval L0,k(T).

A step 68 renews No. m of the next rear cage by "1", and a step 69 decides if the steps 64–68 have been processed for all the cages. In the presence of any unprocessed cage (if m≦4 holds), the calculative flow returns to the step 64 again, whereupon similarly to the foregoing, the predictive cage interval Lm,k(T) is found to renew the minimum cage interval L0,k(T).

When the processing has ended for all the cages, the calculative flow proceeds to a step 70, at which No. k of the next front cage is renewed by "1", and No. m of the rear cage is initialized to "1". Then, the processing of the steps 63–69 is repeated for the new front cage k so as to find the minimum cage interval L0,k(T).

When, in this way, the processing for obtaining the minimum cage intervals L0,k(T) has ended for all the front cages k (k=1, 2, 3 and 4), k>4 holds at a step 71, and the processing of the cage interval prediction program 33C is ended.

By the way, the steps 33A–33C in FIG. 3 construct tentative assignment means 33X.

In the assignment limitation program at a step 33D contained in the group supervision program 10 of FIG. 3, an assignment limitation estimation value P1 for rendering Cage No. 1 difficult of assignment to the new hall call c is calculated on the basis of the minimum cage interval L0,k(T). Incidentally, as the dispersion of the cage intervals L0,1(T)–L04(T) is greater, the assignment limitation estimation value P1 is set at a larger value. This program 33D will be described in detail with reference to FIG. 6.

In the assignment limitation program 33D of FIG. 6, the dispersion of the cage intervals L0,1(T)–L0,4(T) is obtained at a step 72. More specifically, the average value La of the cage intervals L0,1(T)−L0,4(T) is calculated by:

$$La=[L0,1(T)+L0,2(T)+L0,3(T)+L0,4(T)\div 4 \quad (1)$$

Besides, the dispersion or variance Lv of the cage intervals is found as:

$$Lv = [(L0,1(T) - La)^2 + (L0,2(T) - La)^2 + (L0,3(T) - La^2) + (L0,4(T)) - La)^2] \div 3 \quad (2)$$

At a step 73, the dispersion Lv of the cage intervals is weighted by a coefficient Q (=2), and the result is set as the assignment limitation estimation value $P1=Q\times Lv$.

In this way, the assignment limitation estimation value P1 in the case of tentatively allotting the hall call c to Cage No. 1 is set.

In addition, a wait time estimation program at a step 33E contained in the group supervision program 10 of FIG. 3 calculates an estimation value W1 concerning the wait times of the respective hall calls in the case of tentatively allotting the new hall call c to Cage No. 1. Since the calculation of the wait time estimation value W1 is well known, it shall not be described in detail. By the way of example, the predictive wait times U(i) of the respective hall calls i (where i=1, 2, . . . and 22, and the time U(i) is set at "0" second when the corresponding hall call is not registered) are obtained, whereupon the wait time estimation value W1 is obtained in the form of the summation of the squared values of the times U(i) as $W1=U(1)^2+U(2)^2+\ldots+U(22)^2$.

Thus, the assignment limitation estimation value P1 and the wait time estimation value W1 in the case of tentatively allotting the new hall call c to Cage No. 1 are calculated in the tentative assignment estimation program 33 of the Cage No. 1. The assignment limitation estimation values P2–P4 and wait time estimation values W2–W4 of the other cages are similarly calculated by tentative assignment estimation programs 34–36, respectively.

Subsequently, an assigned cage selection program at a step 37 selects one assigned cage on the basis of the assignment limitation estimation values P1–P4 as well as the wait time estimation values W1–W4. In this embodiment, an overall estimation value Ej in the case of tentatively allotting the new hall call c to Cage No. j is found as $Ej=Wj+K\cdot Pj$ (K: constant), and the cage whose overall estimation value Ej becomes the minimum is selected as the regular assigned cage. An assignment command and a preannouncement command corresponding to the hall c are set for the assigned cage.

Further, in a standby operation program at a step 38, when an unoccupied cage having responded to all the hall calls appears, whether the unoccupied cage is caused to stand by in the floor of the final call as it is or to stand by in a specified floor is decided in order to prevent the cages from gathering together in one place. When the standby in the specified floor has been decided, a standby command for running the unoccupied cage to the specified floor is set for this cage. By way of example, the predictive cage intervals of the respective cages after the lapse of the predetermined time T, in the case of tentatively causing the unoccupied cage to stand by in the respective floors, are calculated similarly to the foregoing, and tentative standby floors according to which the cages are prevented from gathering together in one place are selected on the basis of the calculated predictive cage intervals. Then, when the floor of the final call is included in the selected tentative standby floors, the unoccupied cage is kept standing by in the floor of the final call, and when not, the unoccupied cage is caused to run to the tentative standby floor and to stand by there.

Lastly, in an output program at a step 39, the hall button lamp signals 20 set as described above are sent to the halls, and assignment signals, preannouncement signals, standby commands, etc. are sent to the cage control devices 11–14.

In such procedures, the group supervision program at the steps 31–39 is repeatedly executed.

Next, the operation of the group supervision program 10 in this embodiment will be described more concretely with reference to FIGS. 8–10. For the sake of brevity, there will be explained a case where two cages A and B are installed in a building illustrated in FIG. 7.

Figure 8:
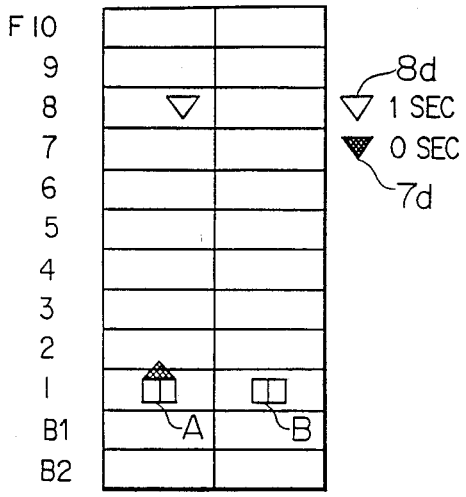
FIGS. 8–10 are diagrams showing the relations between calls and cage positions.

FIG. 8, it is assumed that the down call 8*d* of the 8th floor is allotted to the cage A and that the down call 7*d* of the 7th floor is registered immediately after the allotment (after 1 second). Herein, the predictive wait times of the down call 8*d* of the 8th floor and the down call 7*d* of the 7th floor in the case of tentatively allotting the call 7*d* to the cage A become 15 seconds and 26 seconds, respectively, and the wait time estimation value WA on this occasion becomes $WA=15^2+26^2=901$. On the other hand, the predictive wait times of the down call 8*d* of the 8th floor and the down call 7*d* of the 7th floor in the case of tentatively allotting the call 7*d* to the cage B become 15 seconds and 12 seconds, respectively, and the wait time estimation value WB on this occasion becomes $WB=15^2+12^2=369$. In the prior art assignment system, accordingly, the down call 7*d* of the 7th floor is allotted to the cage B because of WB<WA.

Figure 9:
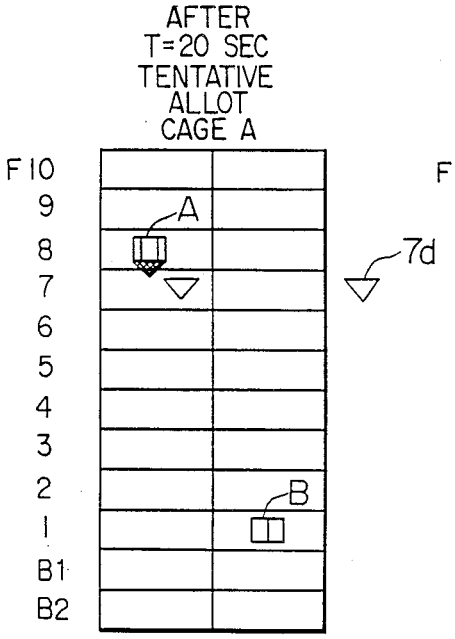
Figure 10:
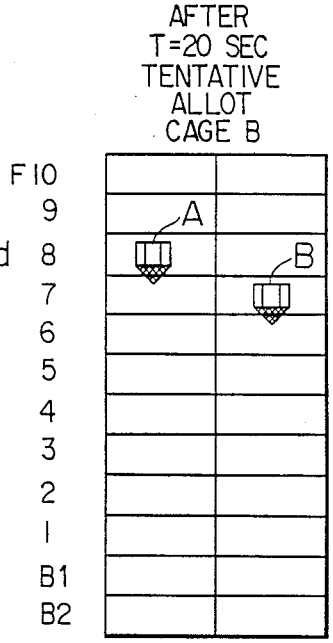

In this regard, the positions of the cages after the lapse of the predetermined time T in the respective cases of tentatively allotting the down call 7*d* of the 7th floor to the cage A and cage B become as illustrated in FIG. 9 and FIG. 10. Accordingly, the predictive cage intervals in the case of the tentative allotment to the cage A become LA,V(20)=14 and LB,A(20)=37, and the minimum cage intervals L0,A(20) and L0,B(20) become L0,A(20)=LB,A(20)=37 and L0,B(20)=LA,B(20)=14, respectively. Therefore, the average value of the cage intervals becomes $La=37+14)/2=25.5$, and the dispersion or variance of the cage intervals becomes $Lv=(37-25.5)^2+(14-25.5)^2=264.5$. On the other hand, the predictive cage intervals in the case of the tentative allotment to the cage B become LA,B(20)=7 and LB,A(20)=45, and the minimum cage intervals L0,A(20) and L0,B(20) become L0,A(20)=LB,A(20)=45 and L0,B(20)=LA,B(20)=7, respectively. Therefore, the average value of the cage intervals becomes $La=(7+45)/2=26$, and the dispersion or variance of the cage intervals becomes $Lv=(7-26)^2+(45-26)^2=722$.

Thus, when the down call 7*d* is tentatively allotted to the cage A, it cannot be said that the cages gather together, and hence, the dispersion of the cage intervals becomes as small a value as Lv=264.5, while the assignment limitation estimation value becomes $PA=2\times264.5=529$. On the other hand, when the down call 7*d* is tentatively allotted to the cage B, the dispersion of the cage intervals becomes as large a value as Lv=722, while the assignment limitation estimation value becomes $PB=2\times722=1444$. Therefore, the overall estimation values become $EA=WA+PA=901+529=1430$ and $EB=WB+PB=369+1444=1813$, and EA<EB holds. Consequently, the down call 7*d* of the 7th floor is finally allotted to the cage A.

With the prior-art assignment system, the down call 7*d* is allotted to the cage B. and the cages will be operated in clustered fashion in the near future illustrated in FIG. 10, so that long wait calls are liable to occur. In contrast, with this embodiment, the down call 7*d* is allotted to the cage A in consideration of the arrangement of the cages to arise after the lapse of the predetermined time T (20 seconds), whereby such a clustered operation can be prevented.

As thus far described, in the foregoing embodiment, the cage positions and cage directions of respective cages to arise when the cages respond to calls in succession since the present point of time, to elapse a predetermined time, are predictively calculated, the temporal intervals of the respective cages to arise after the lapse of the predetermined time are further calculated predictively on the basis of the predicted cage positions and cage directions, and assignment operations as well as standby operations are performed according to the predicted cage intervals. Therefore, the cages are prevented from concentrating in one place, and the wait times of hall calls can be shortened in the near future since the present point of time.

Besides, according to this embodiment, in predicting the cage position and cage direction to arise after the lapse of the predetermine time T, a floor in which the cage will respond to the final call and will become unoccupied cage and a period of time which will be expended till then are first predicted, whereupon the cage position and cage direction after the lapse of the predetermined time T are predicted. This is based on the assumption that, when the cage becomes unoccupied, it stands by in the corresponding floor as it is. In a case where the unoccupied cage is determined to always stand by in a specified floor, the cage position and cage direction may be predicted assuming that the cage is run to the specified floor. In addition, in a traffic situation where the possibility that the cages become unoccupied is low, the is, the volume of traffic is comparatively large, the cage positions and cage directions can also be predictively calculated with ease by omitting the calculations of unoccupied cage prediction times and final call prediction halls and under the condition that the cages do not become unoccupied even after the lapse of the predetermined time T. Further, the cage positions and cage directions can be predicted by considering also calls which will develop anew before the lapse of the predetermined time T. Still further, the final call prediction halls need not always be calculated by the simplified method as in this embodiment, but they may well be finely predicted on the basis of the probabilities of occurrence of cage calls and hall calls obtained statistically.

In addition, in the embodiment, the temporal intervals of the respective cages are evaluated from the predictive cage positions of the individual cages after the lapse of the predetermined time, and the assignment limitation estimation values (>0) of the respective cages for limiting the assignments to a hall call are set on the basis of the dispersion or variance values of the temporal intervals. However, similar effects are attained even when, unlike the temporal intervals, spatial intervals such as the numbers of floors or the distances to-run between the cages are used. Moreover, whether or not the cages concentrate is decided by quantizing the dispersion of the cage arrangement after the lapse of the predetermined time in terms of the average value La of Eq. (1) and the variance Lv of Eq. (2). However, conditions for deciding the concentration of the cages and setting the assignment limitation estimation value are not restricted to the above. By way of example, the assignment limitation estimation value may well be set by expressing whether or not the cages concentrate, in terms of a fuzzy set and digitizing it with the membership function thereof.

Further, as means for limiting the assignment to the hall call, the embodiment uses the system in which for a specified cage, an assignment limitation estimation value larger than those of the other cages is set, this value is weightedly added to a wait time estimation value so as to find an overall estimation value, and the cage whose overall estimation value is the minimum is selected as a regular assigned cage. The ±act that the assignment limitation estimation value is combined with the other estimation value to estimate the cage overall and assign it in this manner, is none other than preferentially assigning the cage of smaller assignment limitation estimation value. That is, the cage of larger assignment limitation estimation value becomes more difficult of assignment than the other cages.

Moreover, the means for limiting the assignment to the hall call is not restricted to that of the embodiment, but is may well be a system in which cages satisfying an assignment limitation condition are expected from the candidates of the assigned cage beforehand. Considered as the system is, for example, one in which the cages of large assignment limitation estimation value are excluded from the assignment candidate cages so that, from among the cages whose assignment limitation estimation values are smaller than a predetermined value, the regular assigned cage may be selected according to a predetermined reference (for example, the minimum wait time estimation value or the shortest arrival time).

Furthermore, in the embodiment, the wait time estimation value is the summation of the squared values of the predictive wait times of hall calls, but the method of calculating the wait time estimation value is not restricted thereto. Obviously this invention is applicable even in case of using, for example, a system in which the summation of the predictive wait times of a plurality of hall calls registered is set as the wait time estimation value or in which the maximum value of such predictive wait times is set as the wait time estimation value. Of course, the estimative item to be combined with the assignment limitation estimative value is not restricted to the wait time, but an estimative index containing a preannouncement miss, the full capacity, or the like as the estimative item may well be combined.

Figure 11:
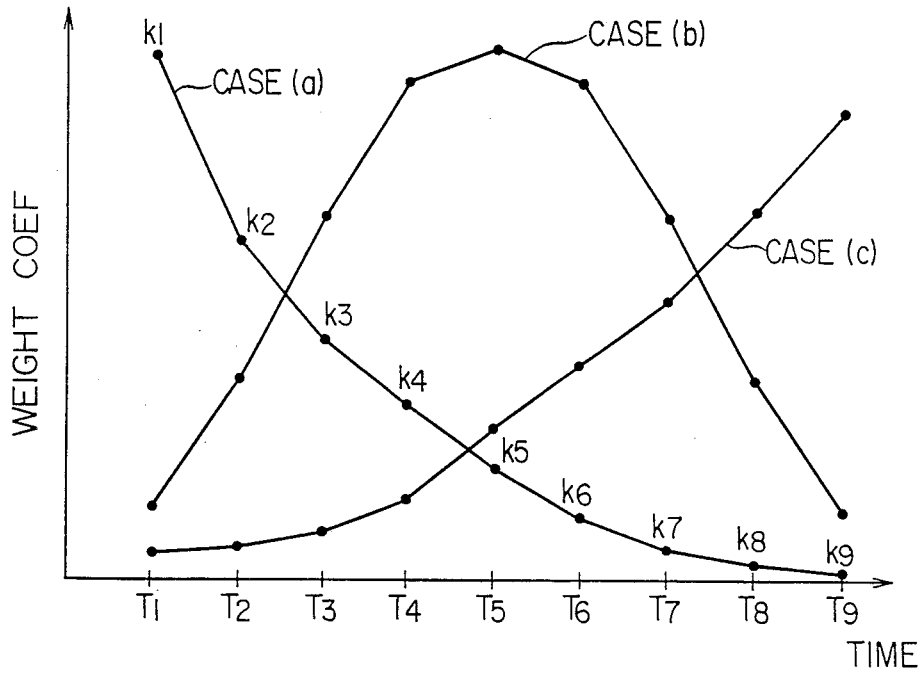
FIG. 11 is a diagram for explaining another embodiment of this invention.
Figure 12:
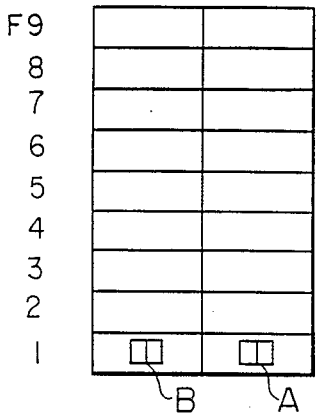
FIG. 12 PRIOR ART
FIG. 12–15 illustrate prior-art group supervision apparatuses for elevator systems, and are diagrams showing the relations between calls and cage positions.
Figure 13:
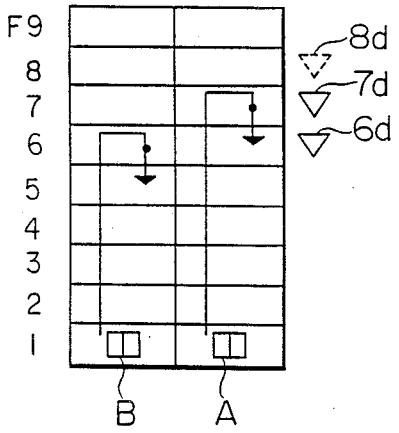
FIG. 13 PRIOR ART
Figure 14:
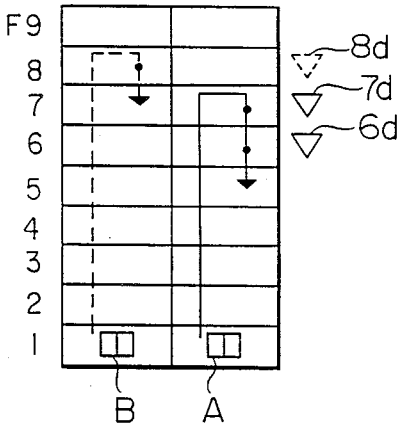
FIG. 14 PRIOR ART
Figure 15:
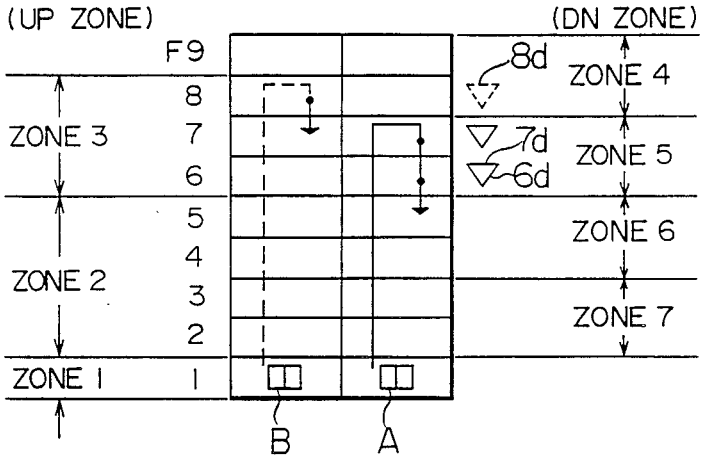
FIG. 15 PRIOR ART

In the embodiment, as to the single predetermined time T, the cage positions and cage directions to arise after the lapse of the predetermined time ar predicted for the respective cages, and the assignment limitation values are calculated on the basis thereof. However, the final assignment limitation estimation value P can also be easily set in the following way: As to a plurality of predetermined times T1, T2, . . . and Tr (T1<T2<. . . <Tr), the cage positions and cage directions of the respective cages after the lapses of the predetermined times are predicted. Further , as to the plurality of predetermined times T1, T2, . . . and Tr, predictive cage intervals L0,K(T1)–L0,K(Tr) (K=1, 2, . . . ) after the lapses of the predetermined times are respectively calculated. Subsequently, assignment limitation estimation values P(T1), P(T2), . . . and P(Tr) respectively set by combinations {L0,1(T1), L0,2(T1), ...}, {L0,1(T2), L0,2(T2), . . . }, . . . and {L0,1(Tr), L0,2(Tr), . . . }are weighted and added, that is, they are processed according to the formula of $P=K1\cdot P(T1)+K2\cdot P(T2)+ \ldots +Kr\cdot P(Tr)$ (where K1, K2, . . . and Kr denote weight coefficients). In this case, the cage arrangement at only the certain point of time T is not noted, but the cage arrangements at the plurality of points of time Ti, T2, . . . and Tr are generally estimated. It is therefore permitted to further shorten the wait times of hall calls in the near future since the present point of time. Regarding the weight coefficients K1, K2, . . . and Kr, several setting methods are considered depending upon which of the above cage arrangements at the plurality of points of time is deemed important, as illustrated in FIG. 11 by way of example, and one of the setting methods may be properly selected in accordance with a traffic situation, the characteristics of a building, etc.

Still further, the embodiment performs the hall call allotment operation on the basis of the predictive cage intervals after the lapse of the predetermined time. The predictive cage intervals can also be utilized as a condition for controlling the basic operations of the cages so as to permit the cages to dispersively respond to hall calls, in such a case where the travelling directions of the cages are determined in the floors of final calls or a case where periods of time for opening doors are lengthened or shortened.

More specifically, in the case of determining the travelling directions of the cages in the floors of the final calls, when it has been predicted by the cage position prediction means that the cage will end responses to calls, the intervals after the lapse of the predetermined time, between his cage predicted to end the responses to the calls and another cage are predicted by the cage interval prediction means as to respective cases where the responses are ended in the up direction and where they are ended in the down direction. Using the cage intervals, there are evaluated a variance $V_u$ in the case where the responses are ended in the up direction and a variance $V_d$ in the case where they are ended in the down direction.

Then, if $V_u \leqq V_d$ holds, a set command for the up direction is issued by the cage control means so as to stop the cage in the up direction, and if $V_u \geqq V_d$ holds, a set command for the down direction is issued.

Besides, in the case of lengthening or shortening the periods of time for opening the doors, the cage intervals after the lapse of the predetermined time are predicted by the cage interval prediction means as to a plurality of door opening times supposed, for example, $t_1$ (=2 seconds), $t_2$ (=4 seconds) and $t_3$ (=6 seconds). Variances $V_1$, $V_2$, $V_3$ corresponding to the respective door opening times are evaluated on the basis of the cage intervals.

Then, the door opening time $t_i$ which affords Min($V_1$, $V_2$, $V_3$) is selected, and it is set by the cage control means.

As described above, a group supervision apparatus for an elevator system in this invention consists, in a group-supervisory elevator system having hall call registration means for registering each hall call when a hall button is depressed, assignment means for selecting a cage to-serve from among a plurality of cages and assigning the selected cage to the hall call, cage control means for performing operation controls such as determining travelling directions of the cages, starting and stopping the cages, and opening and closing doors of the cages, and for causing the cages to respond to cage calls and the hall calls allotted to the assigned cages, and standby means for causing, when the cages have responded to all the calls, the cages to stand by in floors where they have responded, or to run to and stand by at predetermined floors, in that cage positions and cage directions of the respective cages to arise after the cage calls and the allotted hall calls have been successively responded to since the present point of time, to elapse a predetermined time, are predictively calculated by cage position prediction means, that temporal intervals or spatial intervals of the respective cage to arise after the lapse of the predetermined time are predictively calculated on the basis of the predicted cage positions and the predicted cage directions by cage intervals prediction means, and that at least one of said assignment means, said cage control means and said standby means is operated using the predicted cage intervals. Therefore, the changes of the cage arrangement with the lapse of time can be accurately grasped, and the wait times of hall calls in the near future since the present point of time can be shortened.

In addition, the group supervision apparatus is provided with assignment limitation means for limiting a tentative assignment cage in the regular assignment thereof, depending upon the predictive cage interval after the lapse of the predetermined value, under the assumption that the hall call is tentatively allotted by tentative assignment means and that the respective cages respond to the tentatively allotted hall call. This produces the effect that the cages can be avoided from being assigned to some floor zones ununiformly.

What is claimed is:

1. In a group-supervisory elevator system having hall call registration means for registering each hall call when a hall button is depressed, assignment means for selecting a cage to-serve from among a plurality of cages and assigning the selected cage to the hall call, and cage control means for performing operation controls such as determining travelling directions of the cages, starting and stopping the cages, and opening and closing doors of the cages, and for causing the cages to respond to cage calls and the hall calls;

a group supervision apparatus for an elevator system comprising cage position means for predictively calculating cage positions and cage directions of the respective cages after the cage calls and the allotted hall calls have been successively responded to since the present point of time, during a predetermined time, and cage interval prediction means for predictively calculating intervals of the respective cages to arise after lapse of the predetermined time, on the basis of the predicted cage positions and the predicted cage directions, wherein the cage to-serve is selected from among the plurality of cages and is assigned by said assignment means under a condition that the cage intervals predicted by said cage interval prediction means are used as one item of estimation.

2. A group supervision apparatus for an elevator system as defined in claim 1, wherein said assignment means includes assignment limitation means, and wherein said assignment limitation means operates so that the cage predicted by said cage interval prediction means so as to shorten the cage interval may be difficult to assign to the hall call, whereupon said assignment means assigns the cage to-serve.

3. A group supervision apparatus for an elevator system as defined in claim 1, wherein said assignment means includes assignment limitation means, and wherein said assignment limitation means operates so that the cage predicted by said cage interval prediction means so as to shorten the cage interval may be excluded from the cages which are to be assigned to the hall call, whereupon said assignment means assigns the cage to-serve from among the remaining cages.

4. In a group-supervisory elevator system having hall call registration means for registering each hall call when a hall button is depressed, assignment means for selecting a cage to-serve from among a plurality of cages and assigning the selected cage to the hall call, cage control means for performing operation controls such as determining travelling directions of the cages, starting and stopping the cages, and opening and closing doors of the cages, and for causing the cages to respond to cage calls and the hall calls, and standby means for causing, when the cages have responded to all the calls, the cages to stand by in floors where they have responded, or to run to predetermined floors and stand by therein;

a group supervision apparatus for an elevator system comprising cage position prediction means for predictively calculating cage positions and cage directions of the respective cages after the cage calls and the allotted hall calls have been successively responded to since the present point of time, during a predetermined time, and cage interval prediction means for predictively calculating intervals of the respective cages to arise after lapse of the predetermined time, on the basis of the predicted cage positions and the predicted cage directions, wherein using the cage intervals predicted by said cage interval prediction means, said standby means determines the floors where the cages having responded to all the calls are to stand by, and it causes the cages to stand by at the determined floors.

5. In a group-supervisory elevator system having hall call registration means for registering each hall call when a hall button is depressed, assignment means for selecting a cage to-serve from among a plurality of cages and assigning the selected cage to the hall call, and cage control means for performing operation controls such as determining travelling directions of the cages, starting and stopping the cages, and opening and closing doors of the cages, and for causing the cages to respond to cage calls and the hall calls;

a group supervision apparatus for an elevator system comprising cage position prediction means for predicting whether or not the cages will end responses to the calls after the cage calls and the allotted hall calls have been successively responded to since the present point of time, during a predetermined time, and for predictively calculating cage positions and cage directions of the respective cages, and cage interval prediction means for predictively calculating, when the end of the responses of cages to the calls has been predicted by said cage position prediction means, intervals between a cage predicted to end the responses to the calls and another of the cages and after lapse of the predetermined time, as to respective cages where the cage ends the response in an up direction and where the cage ends them in a down direction, wherein using the cage intervals predicted by said cage interval prediction means, said cage control means determines the travelling direction of the cage predicted to end the responses.

6. In a group-supervisory elevator system having hall call registration means for registering each hall call when a hall button is depressed, assignment means for selecting a cage to-serve from among a plurality of cages and assigning the selected cage to the hall call, and cage control means for performing operation controls such as determining travelling directions of the cages, starting and stopping the cages, and opening and closing doors of the cages, and for causing the cages to respond to cage calls and the hall calls;

a group supervision apparatus for an elevator system comprising cage position prediction means for predictively calculating cage positions and cage directions of the respective cages after the cage calls and the allotted hall calls have been successively responded to since the present point of time, during a predetermined time, in relation to each of a plurality of supposed door opening times, and cage interval prediction means for predictively calculating intervals of the respective cages to arise after the lapse of the predetermined time, on the basis of the predicted cage positions and the predicted cage directions, in relation to each of the supposed door opening times, wherein using the cage intervals predicted by said cage interval prediction means, said cage control means sets the door opening times.

* * * * *